US011021895B2

(12) United States Patent
Bouan

(10) Patent No.: US 11,021,895 B2
(45) Date of Patent: Jun. 1, 2021

(54) ANTI-THEFT DEVICE FOR CANS, TINS OR BOTTLES

(71) Applicant: FORS FRANCE, Champigny sur Marne (FR)

(72) Inventor: Bruno Bouan, La Varenne Saint Hilaire (FR)

(73) Assignee: FORS FRANCE, Champigny sur Marne (FR)

( * ) Notice: Subject to any disclaimer, the term of this patent is extended or adjusted under 35 U.S.C. 154(b) by 360 days.

(21) Appl. No.: 16/307,247

(22) PCT Filed: May 17, 2017

(86) PCT No.: PCT/FR2017/051190

§ 371 (c)(1),
(2) Date: Dec. 5, 2018

(87) PCT Pub. No.: WO2017/212133

PCT Pub. Date: Dec. 14, 2017

(65) Prior Publication Data

US 2019/0345743 A1 Nov. 14, 2019

(30) Foreign Application Priority Data

Jun. 8, 2016 (FR) ..... 1655270

(51) Int. Cl.
*E05B 73/00* (2006.01)

(52) U.S. Cl.
CPC ..... *E05B 73/0041* (2013.01); *E05B 73/0052* (2013.01)

(58) Field of Classification Search
CPC ..... G08B 13/14; G08B 13/24; E05B 73/00; E05B 73/0041; E05B 73/0052
(Continued)

(56) References Cited

U.S. PATENT DOCUMENTS 5,957,313 A 9/1999 Bouan
7,583,195 B2 9/2009 Chua et al.
(Continued)

FOREIGN PATENT DOCUMENTS

CN 201439407 U 4/2010
EP 2734696 B1 9/2016
(Continued)

OTHER PUBLICATIONS

International Search Report for PCT/FR2017/051190.

*Primary Examiner* — Suzanne L Barrett
(74) *Attorney, Agent, or Firm* — Bachman & LaPointe, P.C.

(57) ABSTRACT

An anti-theft device for an item having a peripheral shoulder, comprising two hinged portions each having a peripheral skirt provided with an edge capable of abutting under the peripheral shoulder, with the portions being hinged relative to a peripheral pivot; magnetically deactivatable locking means, which lock the two hinged portions in the closed position, and a detection means wherein the portions are made up of a stationary shell having a general cylindrical shape, the cross-section of which matches the cross-section of the item to be protected and a movable shell connected by a pivot, the stationary shell having a recess opening laterally to allow the insertion of the movable shell in closed position.

9 Claims, 5 Drawing Sheets

(58) Field of Classification Search
USPC ..... 70/57.1, 58, 232; 340/572.9
See application file for complete search history.

(56) References Cited

U.S. PATENT DOCUMENTS

| | | | | |
|---|---|---|---|---|
| D727,191 | S * | 4/2015 | Yang | D10/106.92 |
| 9,311,797 | B2 * | 4/2016 | Yang | G08B 13/2434 |
| 9,518,407 | B2 | 12/2016 | Thoonsen | |
| 2004/0050724 | A1 * | 3/2004 | Grul | G09F 27/00 206/217 |
| 2005/0237205 | A1 * | 10/2005 | Gorst | G08B 13/2434 340/572.9 |
| 2007/0262876 | A1 * | 11/2007 | Marsilio | E05B 73/0023 340/572.8 |
| 2008/0284601 | A1 * | 11/2008 | Sayegh | E05B 73/0017 340/572.1 |
| 2008/0291025 | A1 * | 11/2008 | Perez | E05B 73/0052 340/572.1 |
| 2010/0005840 | A1 * | 1/2010 | Hogan | E05B 73/0017 70/63 |
| 2010/0060460 | A1 * | 3/2010 | Zinner | B65D 55/02 340/572.9 |
| 2010/0242552 | A1 * | 9/2010 | Sayegh | E05B 73/0017 70/58 |
| 2015/0137977 | A1 | 5/2015 | Yang | |
| 2016/0275768 | A1 * | 9/2016 | Strassburger | G08B 13/2434 |

FOREIGN PATENT DOCUMENTS

| | | | |
|---|---|---|---|
| FR | 2735751 | A1 | 12/1996 |
| WO | 2010055449 | A2 | 5/2010 |
| WO | 2016034748 | A1 | 3/2016 |

* cited by examiner

ANTI-THEFT DEVICE FOR CANS, TINS OR BOTTLES

BACKGROUND OF THE INVENTION

The present invention relates to the field of anti-theft devices. It is intended to protect items distributed freely, for example displayed on supermarket shelves.

Such items are well known and generally include a plastic body which can be attached to the item to be protected against shop-lifting. This body contains a detection means interacting with a gantry placed at the exit of the point of sale. A magnetic locking system prevents the body from opening and the anti-theft device from being removed by anyone who does not have the appropriate unlocking device.

The invention more particularly relates to the field of locks intended for packaging with a groove for a peripheral rib such as a beverage can, a tin, or a bottle with an annular ring on the neck.

For such items, various solutions are available.

A first family of solutions relates to locks with a strap that can surround a portion of the item to be protected. The European patent application EP 2734696 describes an anti-theft device comprising a ring, means for locking the ring in closed position, and anti-theft detection means. The ring comprises a body which has a first end near which the locking means are associated, a free opposite second end to be inserted into the locking means, and at least one circular portion extending from the second end and intended to cooperate with said locking means.

The body of the ring includes a linear portion arranged as an extension of the circular portion opposite the second end. The linear portion imparts additional elasticity to the device involved in ejecting the second end of the ring from the locking means.

The strength of such solutions is very limited because it is easy to force the opening by engaging a blade between the item and the ring, in order to widen it or cause it to break.

The patentee was a pioneer in another approach where the anti-theft device is in the form of a hollow body with a recess having a shape matching a portion of the item to be protected in order to cap same. The French patent FR2735751 describes such an anti-theft device for an item having a substantially cylindrical end provided with a substantially annular bulge, for example a bottle or a vial. It consists of a removable body comprising means capable of clamping, in closed position, said cylindrical end and locking means for preventing the opening of said means without using a specific tool. The body is formed by a substantially tubular element having a diameter larger than the diameter of the annular bulge provided with a member movable relative to the tubular element between a closed position in which it delimits a section smaller than the section of the annular bulge and an unlocked position in which it delimits a section larger than the section of the annular bulge.

This solution is much stronger. However, it is limited to small diameter items with a very significant shoulder.

However, it is not suitable for protecting items without a neck, such as a beverage can or a tin.

For the protection of such items, a solution described in the U.S. Pat. No. 7,583,195 has been proposed in the prior art.

This patent relates to a reusable security tag intended to be used with containers. The security tag is made up of two sections which are pivotally connected to first section ends and the sections include semi-circular, outwardly extending edges. A security tag is associated with one of the two sections. A removable pin of a locking mechanism locks the respective pin receptacles of each section together. The edges are coupled to the lower edge of one end of a container whereon the closing of the free ends of the two sections on a hinge causes the pin to be locked via the pin receptacles. The only way to remove the pin and therefore to release the security tag from the container is to position the security tag/container assembly near a magnet with a suitable size available at a point of sale in a retail store. Failure to remove the security tag before the items leaves the retail store causes the integrated electronic components to detect the security tag and trigger an alarm or another warning device.

These solutions are not satisfactory for several reasons.

They generally have a vertical or horizontal gap into which a blade can easily be inserted to separate the two portions making up the anti-theft device and thus allow the item to be forced out. These devices are therefore not strong enough to seriously resist a fraudulent withdrawal attempt.

They are also not suitable for protecting metal items because the detection means is disturbed by the proximity of the metal mass of the item.

SUMMARY OF THE INVENTION

In order to remedy these drawbacks, the invention relates to an anti-theft device intended for the protection of items, in particular metallic items, having a peripheral shoulder of any shape: tubular with a circular, rectangular or polygonal section, or provided with a neck. The device according to the invention has a high resistance and can be used on metallic items.

The invention, in its broadest sense, relates to an anti-theft device for an item having a peripheral shoulder, consisting of two hingedly connected portions. Each of these portions has a peripheral skirt with one edge capable of abutting under the peripheral shoulder of the item to be protected.

These two portions are hingedly connected relative to a peripheral pivot between:

a closed position where both parties surround a peripheral area of the item, and an open position where both parties are separated to allow the item to be removed.

The device also includes a magnetically deactivatable locking means that locks the two hingedly connected portions in closed position and a detection means.

These two portions consist of a stationary and a movable shell connected by a pivot.

The stationary shell has a recess that opens laterally to allow the movable shell to be inserted when the device is in closed position.

The movable shell is made up of a body having a cross-section corresponding to the cross-section of the item to be protected extended on the side of the item to be protected by a skirt extending over a first half of the periphery of the item to be protected and having a peripheral shoulder.

The movable shell may be made up of a single moulded portion with a skirt and an insert forming said transverse extension, the configuration of which matches that of the recess provided in the stationary shell.

It may also consist of an assembly formed by a moulded portion having a skirt and a housing for receiving an additional transverse extension, the configuration of which matches that of the recess provided in the stationary shell on the one hand and said housing on the other hand. In this last alternative solution, the anti-theft device then consists of a stationary shell hingedly connected to a movable shell, and an additional insert.

Preferably, the stationary shell has a protrusion on the side opposite the item to be protected, in which the detection means is received.

Advantageously, the stationary shell has two transverse walls defining the recess between them, with the two walls being closed on the side opposite the movable portion by a peripheral edge.

In one alternative solution, the movable shell has a transverse body reinforced by stiffeners.

In another alternative solution, the stationary shell has a hollow extension that guides a locking rod, the end of which is engaged in a housing provided in the movable shell.

Advantageously, the movable shell has an arched guide path leading to said housing.

Preferably, the movable shell and the stationary shell have peripheral protrusions respectively through which said pivot passes, said protrusions being arranged on the side opposite the locking means.

In a particular alternative solution, the protrusion has an upper surface matching the lower surface of the items to be protected to allow the stacking of protected items.

Advantageously, the movable shell has a tooth that engages, in closed position, into a matching recess provided on the protrusion.

According to a particular alternative solution, the protrusion and the housing form an abutting surface for the lower surface of the items to be protected.

BRIEF DESCRIPTION OF THE DRAWINGS

The present invention will be best understood upon reading the following detailed description of a non-restrictive exemplary embodiment, while referring to the appended drawings, wherein.

DETAILED DESCRIPTION

Figure 1:
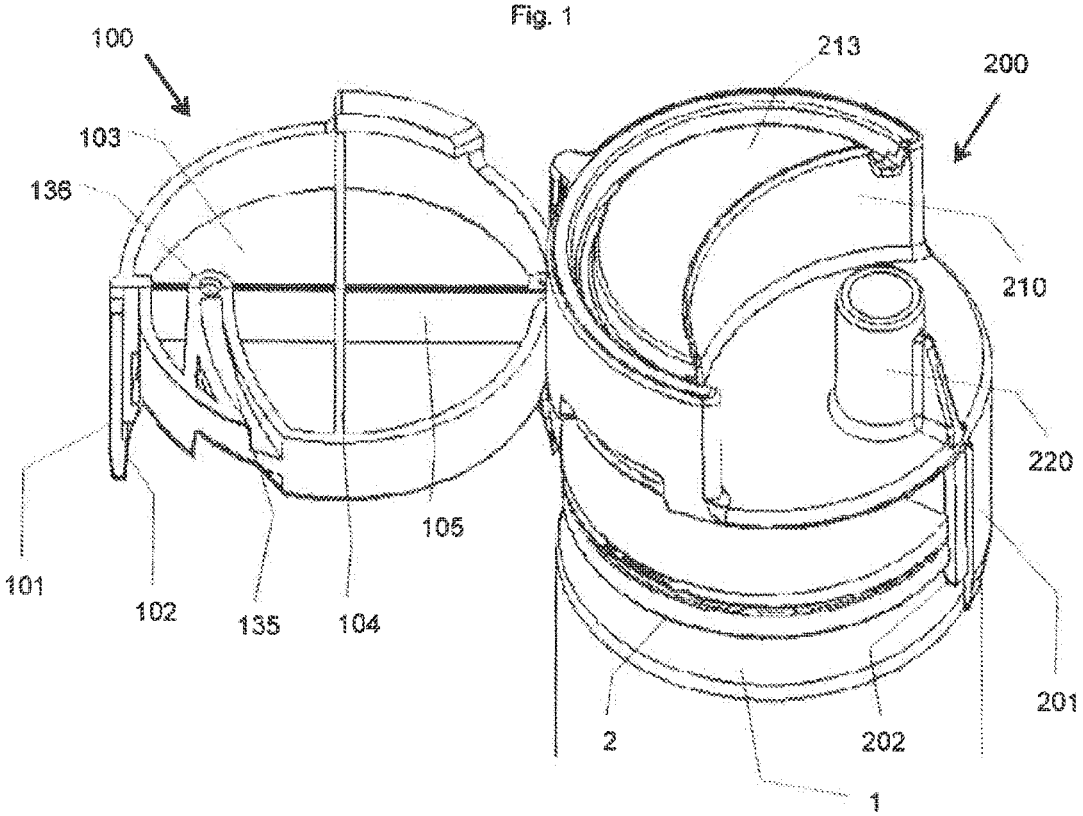
FIG. 1 shows a top three-quarter view, in perspective, of the device in the open position
Figure 2:
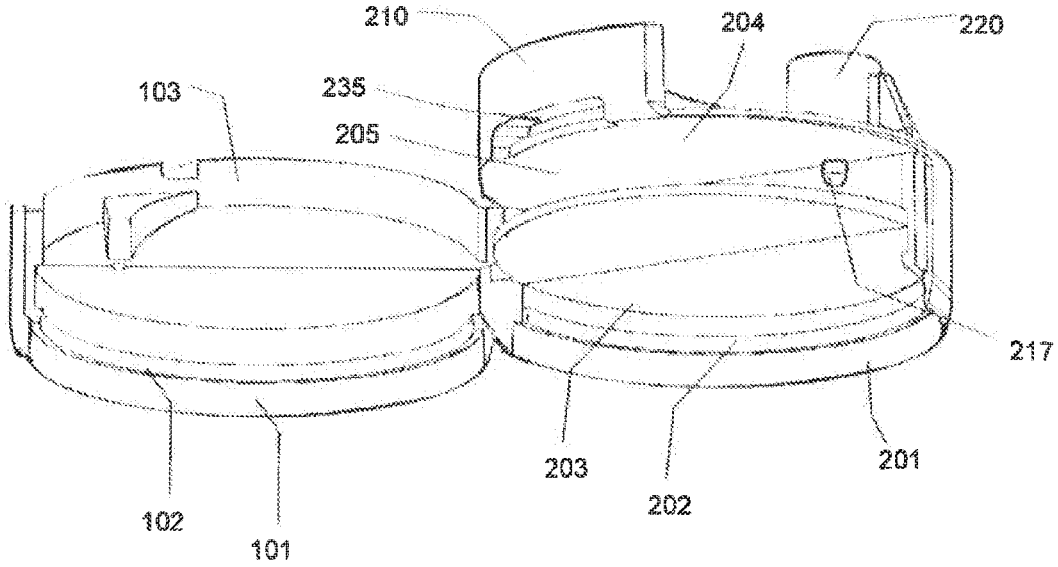
FIG. 2 shows a three-quarter perspective view of the underside of the device in the open position
Figure 3:
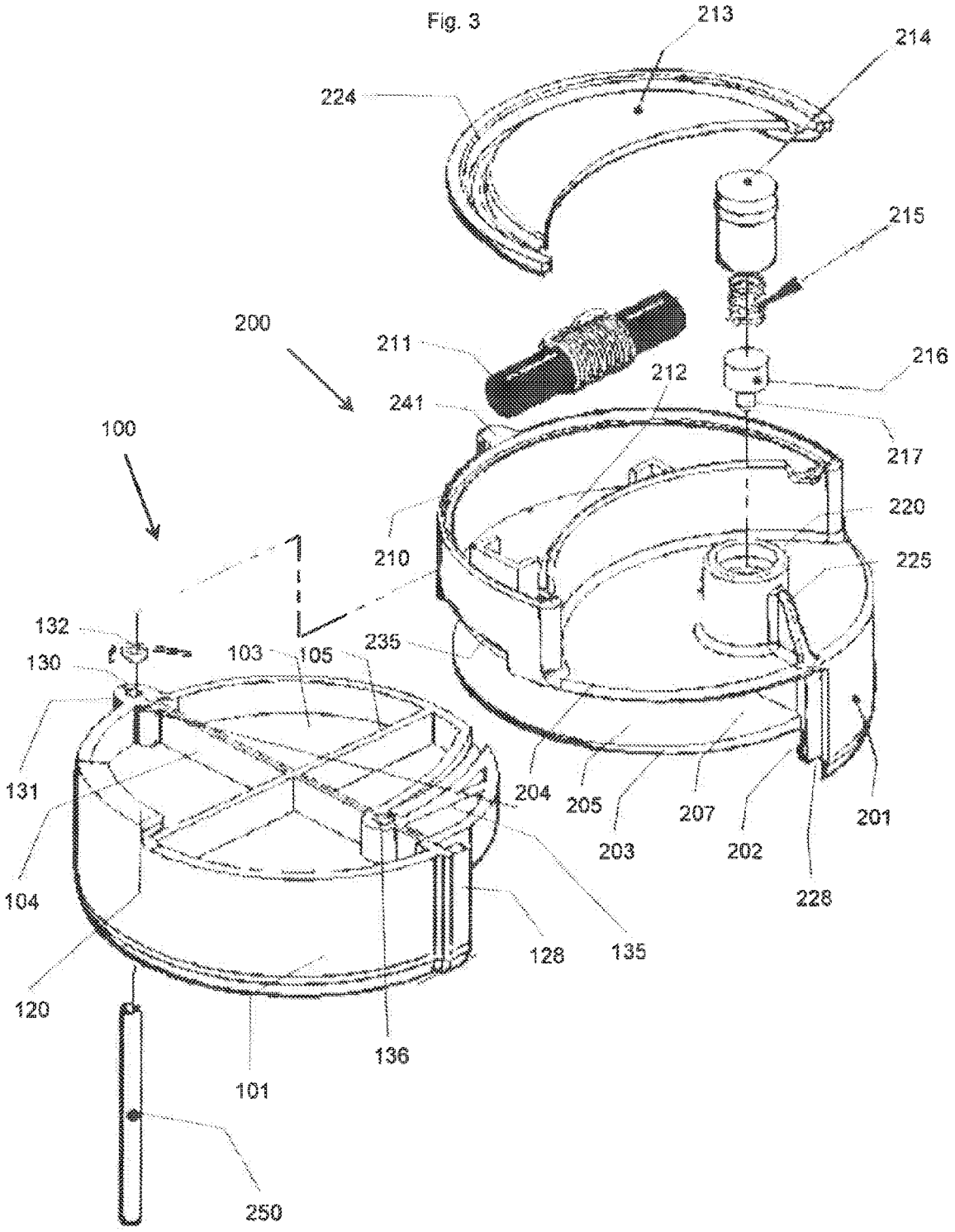
FIG. 3 shows an exploded view of the device in the open position

The anti-theft device according to the invention is described hereunder according to a particular example of implementation for the protection of metal cans.

It consists of a movable moulded shell 100 and a stationary moulded shell 200. The two shells are joined by a pivot 250 engaged in protrusions 131, 241 provided at the peripheral edge of the shells 100, 200.

The two shells 100, 200 each have a skirt 101, 201 having a semi-tubular shape, respectively, to match the outer surface of the item 1 to be protected. Each of these skirts 101, 201 has, on its inner surface, a peripheral shoulder 102, 202 respectively capable of resting against a shoulder surrounding the upper portion of the item to be protected. These shoulders can be formed by moulding. They may also consist of added parts intended to be placed in a housing provided for this purpose in the skirts 101, 201.

The stationary shell 200 has a general cylindrical shape, the cross-section of which matches the cross-section of the item 1 to be protected.

The stationary shell 200 has two transverse walls 203, 204 which are solid in the example described. They may also have holes to lighten the anti-theft device. However, the upper transverse wall 204 is preferably solid to completely close the device and prevent access to the can cover and to the opening ring.

These two transverse walls 203, 204 define between them a recess 205 5 to 10 mm high, closed on the side opposite the movable shell 100 by a peripheral edge and open on the movable shell 100 side by a slot enabling the movable shell to be inserted therein.

In closed position, the movable shell 100 is received in this recess 205.

The stationary shell 200 has a skirt 201 stretching over half the periphery of the item 1 to be protected, on the side opposite the movable shell 100. This peripheral skirt 201 has, on its inner surface, a peripheral shoulder 202 that engages under the shoulder 2 surrounding the upper edge of the item 1. This shoulder 2 may be made up of a peripheral rib or of the upper surface of a peripheral groove.

The upper surface of the stationary shell 200 has a protrusion 210. This protrusion 210 defines a housing for receiving the detection means 211, in this example tuned ferrite. Of course, any known, magneto-acoustic, electromagnetic or radiofrequency detection means can be used, for example a label with a tuned LC circuit or an RFID tag.

The detection means shall be more than 5 mm away from the surface of the item to be protected and preferably more than 10 mm away. This distance limits the disturbances caused by the metal mass on the operation of radiofrequency detection. This distance results from the height of the recess 205 and the trays 203, 204 and possibly from a base provided in the protrusion 210.

The protrusion 210 is closed by a welded or glued or snapped-on cover 213. It is also possible to inject a coating resin after the introduction of the detection means.

Figure 4:
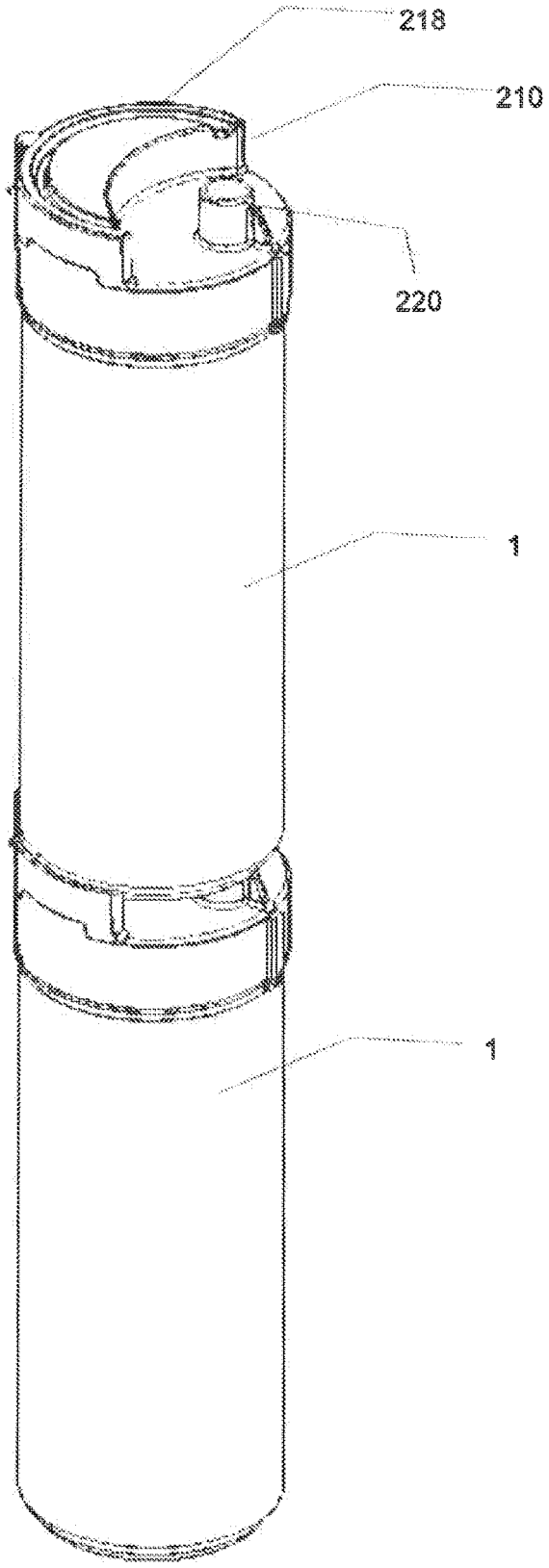
FIG. 4 shows an exploded view of a stack of two items stacked with the devices in closed position
Figure 5:
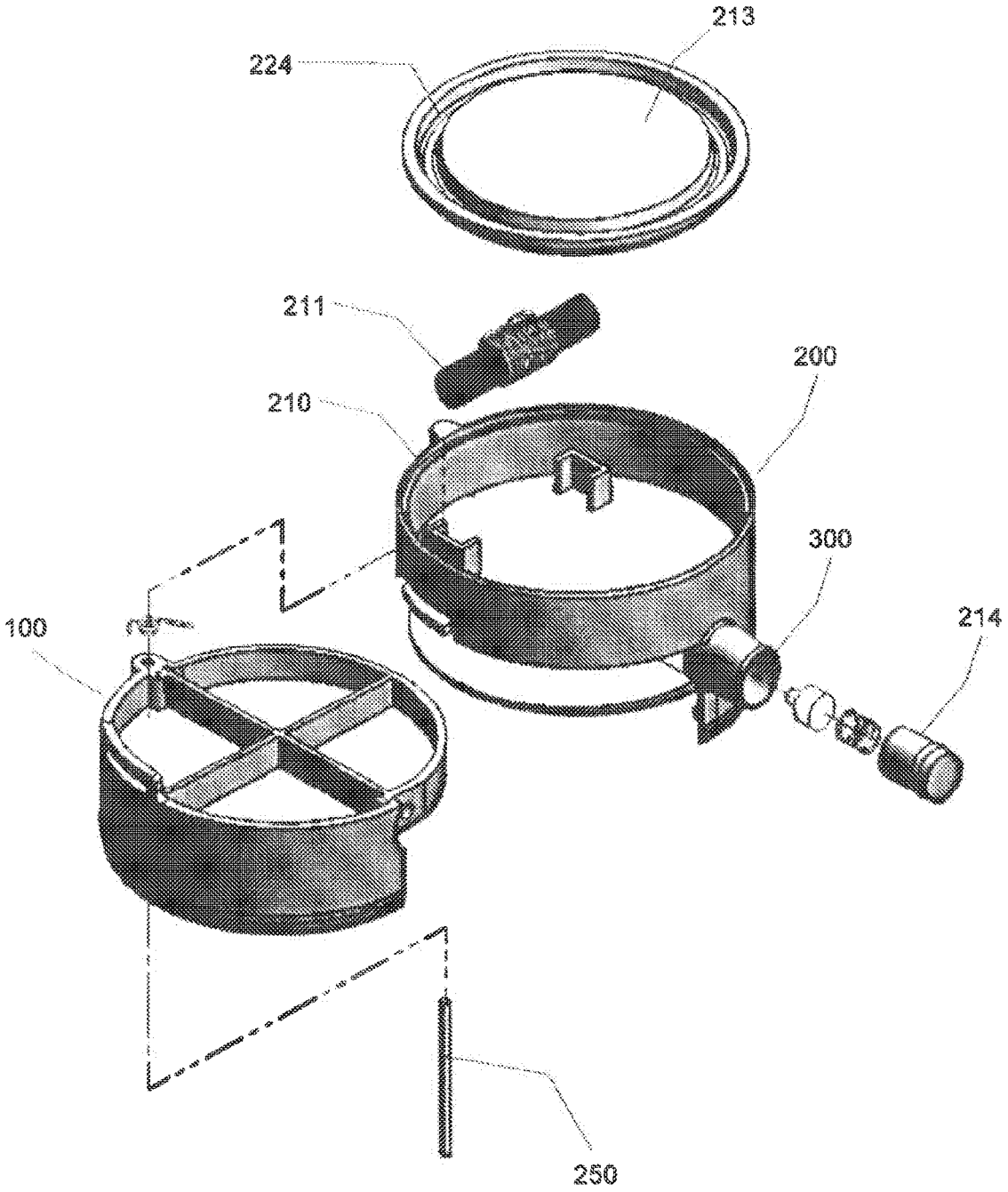
FIGS. 5 to 8 show views of an alternative embodiment, i.e. top and bottom exploded view and perspective view in open position, and in closed position, respectively.
Figure 6:
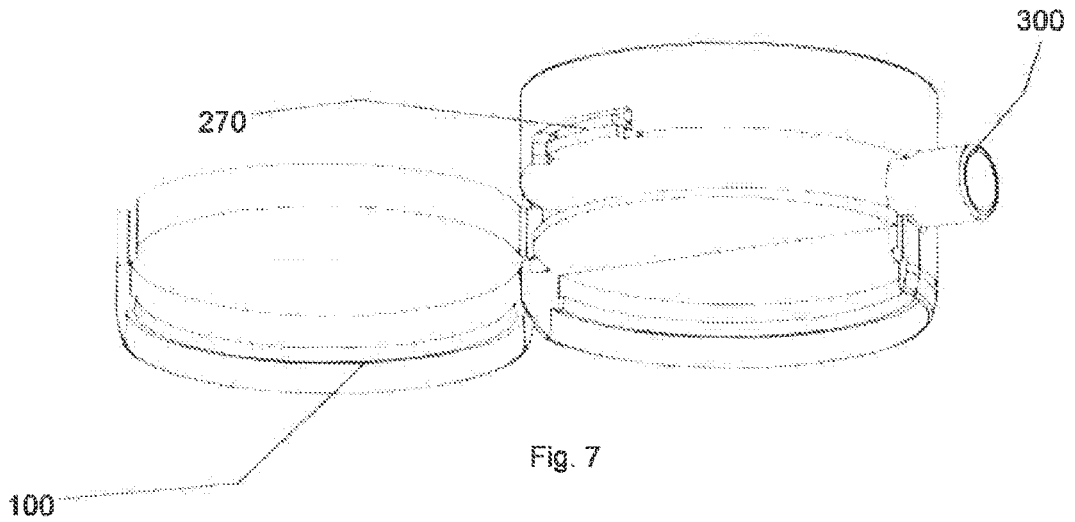
Figure 7:
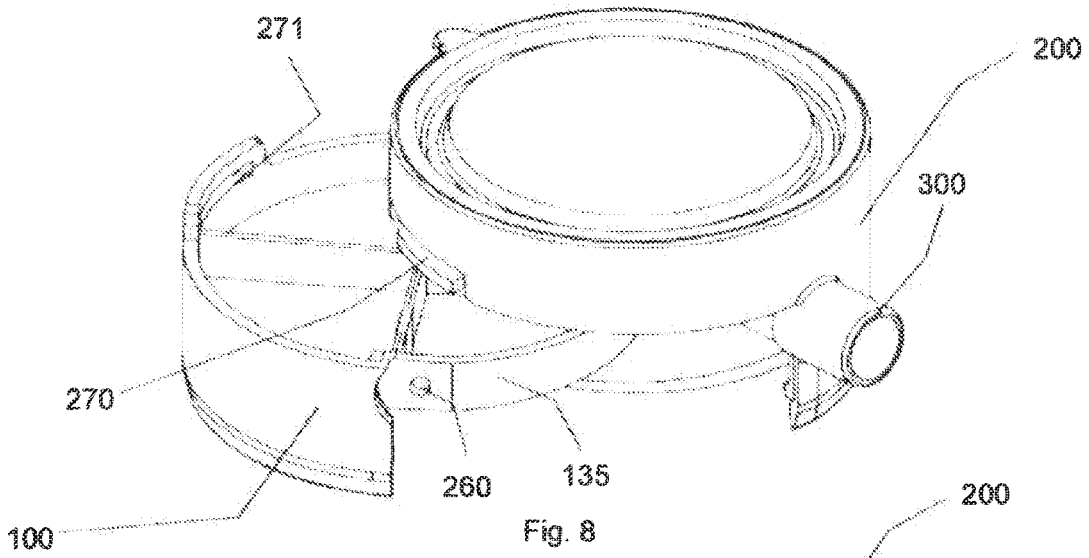
Figure 8:
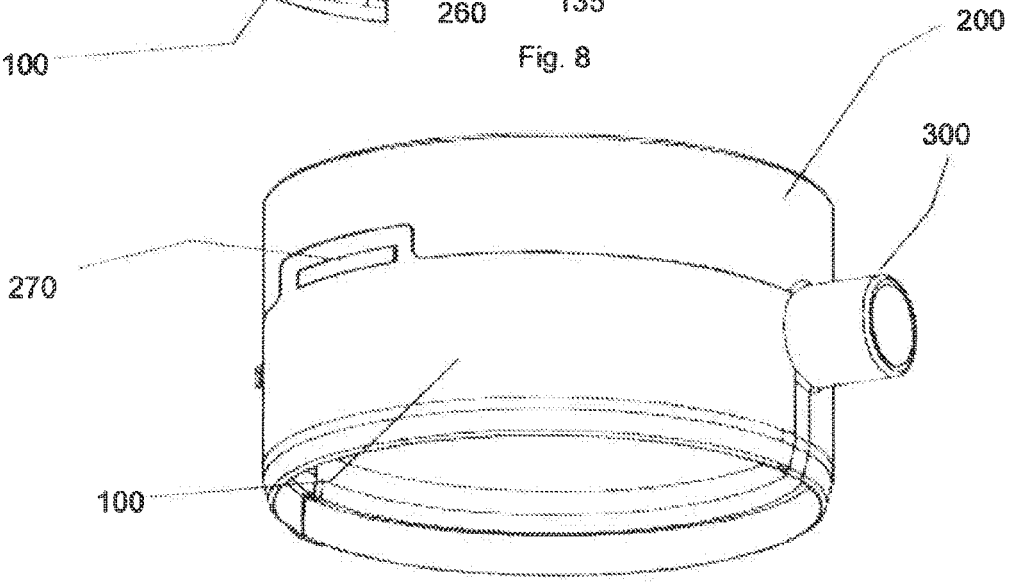

The upper portion of the protrusion has a groove 224 matching the lower surface of the items to enable the stacking of several protected items as shown in FIG. 4.

The protrusion 210 forms a stud covering slightly more than half the upper surface, with a groove 22' to provide stability to the next item, when stacking.

The upper surface of the stationary shell 200 includes, in addition to the protrusion 210 having a groove 224, a shoulder having a support surface 225 to provide an additional support surface for the bottom of the stacked item.

The extension 220 guides a plastic cage 214 which non-detachably snap-fits the feeder head housing and spring thereof. This plastic cage also guides the feeder head.

This cage 214 actuates a locking rod 216, the end 217 of which engages into a matching housing 136 provided on the movable shell 100 to block the relative movement of the two shells 100, 200 when these are in closed position, with the movable shell 100 being engaged in the recess 205 of the stationary shell 200.

The movable shell 100 has a transverse body formed by a transverse plate 103 which can be solid or open-work, and which has diametrically extending stiffeners 104, 105. The transverse plate 103 is surrounded by a peripheral edge, the height of which corresponds to the height of the recess 205 of the stationary shell, on the side facing this stationary shell 200. This edge is slightly higher to cover the field of the plates 203, 204 of the stationary shell 200 and prevent an interstitial gap from allowing the introduction of a blade.

This edge is extended by a tooth 120 defining a shoulder directed towards the item 1. This tooth 120 engages, in closed position, into a matching recess 235 to improve resistance against an attempt to separate the two shells in the locked position.

The movable shell 100 has a skirt 101 extending over half the periphery of the item 1 to be protected to form, together with the skirt 201 of the stationary shell 200, a belt completely surrounding the upper peripheral edge of the item 1 to be protected. This skirt 201 also has a shoulder 202 that engages into the peripheral rib 2 of the item to be protected 1.

The connection between the shells 100, 200 is provided by a pivot 250. A spring 132 surrounding this pivot 250 causes the movable shell 100 to open relative to the stationary shell 200 when same are unlocked.

The plate 103 also has an arched protrusion 135 with a rib which the end 217 of the locking rod 216 engages into. This rib leads to the housing 136 which the end 217 engages into to lock the two shells in the locked position.

In addition, the end 128 of the skirt 101 of the movable shell 100 has a tenon shape which is embedded in the matching end 228 of the skirt 201 of the stationary shell which has a mortise shape. This configuration prevents a blade from being inserted to force the separation of the two skirts 101, 201.

The device described by way of example is not limited to items with a circular cross-section. It can be configured for items having a rectangular, polygonal or any other cross-section. It can also be configured to protect a bottle provided with a neck and a ring.

FIGS. 5 to 8 illustrate an alternative embodiment where the locking means is not placed on the upper portion of the stationary shell 100 but laterally thereto.

The stationary shell 200 has a tubular housing 210 for receiving the detection means 211. It is closed by a disc-shaped cover 213 with a rib 224 intended to receive the bottom of the next can. The stationary shell 200 has a lateral extension 300 in which the magnetic locking/unlocking mechanism, in particular the feeder head 219, is received.

The arched guide track 135 has a hole 260 which the end of the locking rod is inserted into. In an alternative solution, the arched guide track 135 may have notches for locking the locking rod by the bevelled end thereof. This solution allows the section of the device to be adapted to different sections of items to be protected.

The stationary shell 200 also has a radially extending tooth 270 that engages into a matching hole 271 provided in the movable shell 100.

The invention claimed is:

1. An anti-theft device for an item having a peripheral shoulder, comprising two hinged portions each having a peripheral skirt provided with an edge capable of abutting under said peripheral shoulder, with the portions being hinged relative to a peripheral pivot between a closed position where the two portions surround a peripheral zone of the item, and an open position where the two portions are spaced apart to enable removing the item, with the device further comprising magnetically deactivatable locking means, which lock the two hinged portions in the closed position, and a detection means wherein said portions are made up of a stationary shell having a general cylindrical shape, the cross-section of which matches the cross-section of the item to be protected and a movable shell connected by a pivot, the stationary shell having a recess opening laterally to allow the insertion of the movable shell in closed position, the movable shell comprising a body having a cross-section matching the cross-section of the item to be protected, extended on the side of the item to be protected by a skirt stretching over a first half of the periphery of the item to be protected and having a peripheral shoulder, with the stationary shell having on the side opposite the item to be protected a projection in which the detection means is received.

2. The anti-theft device according to claim 1, wherein the stationary shell has two transverse walls defining said recess between them, with the two walls being closed on the side opposite the movable portion by a peripheral edge.

3. The anti-theft device according to claim 1, wherein the movable shell has a transverse body reinforced by stiffeners.

4. The anti-theft device according to claim 1, wherein the stationary shell has a hollow extension guiding a locking rod, the end of which is engaged in a housing provided in the movable shell.

5. The anti-theft device according to claim 1, wherein the movable shell has an arched guide path leading to said housing.

6. The anti-theft device according to claim 1, wherein the movable shell and the stationary shell have peripheral protrusions respectively through which said pivot passes, with said protrusions being arranged on the side opposite the locking means.

7. The anti-theft device according to claim 1, wherein the protrusion has an upper surface matching the lower surface of the items to be protected to enable the stacking of protected items.

8. The anti-theft device according to claim 1, wherein the movable shell has a tooth which engages, in closed position, into a matching recess provided on the protrusion.

9. The anti-theft device according to claim 7, wherein the protrusion and the housing form a support surface for the lower surface of the items to be protected.

* * * * *